US009975214B2

(12) United States Patent
Liao et al.

(10) Patent No.: US 9,975,214 B2
(45) Date of Patent: May 22, 2018

(54) COMPOSITE POLISHING PAD HAVING LAYERS WITH DIFFERENT HARDNESS AND PROCESS FOR PRODUCING THE SAME

(71) Applicant: NAN YA PLASTICS CORPORATION, Taipei (TW)

(72) Inventors: Te-Chao Liao, Taipei (TW); Chun-Che Tsao, Taipei (TW); Wen-Jui Cheng, Taipei (TW); Tzai-Shing Chen, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 183 days.

(21) Appl. No.: 15/234,013

(22) Filed: Aug. 11, 2016

(65) Prior Publication Data

US 2017/0050288 A1 Feb. 23, 2017

(30) Foreign Application Priority Data

Aug. 17, 2015 (TW) ..... 104126675 A

(51) Int. Cl.
*B24B 37/22* (2012.01)
*B24D 3/32* (2006.01)

(52) U.S. Cl.
CPC ..... *B24B 37/22* (2013.01)

(58) Field of Classification Search
CPC ..... B24B 37/22; B24D 11/04; B24D 3/32; B24D 3/34
USPC ..... 451/526, 532, 534, 527, 530; 51/297, 51/298, 293
See application file for complete search history.

(56) References Cited

U.S. PATENT DOCUMENTS 4,078,340 A * 3/1978 Klecker ..... A22C 11/00 51/295
8,092,280 B2 * 1/2012 Ishida ..... B24B 37/24 428/848.9
8,162,728 B2 * 4/2012 James ..... B24B 37/24 428/304.4
8,408,977 B2 * 4/2013 James ..... B24B 37/24 428/304.4
9,707,663 B2 * 7/2017 Shiro ..... B24B 37/24
2005/0112354 A1 * 5/2005 Kume ..... B24D 3/32 428/304.4
2006/0046622 A1 * 3/2006 Prasad ..... B24B 37/26 451/41
2007/0010175 A1 * 1/2007 Feng ..... B24B 37/30 451/41
2008/0171493 A1 * 7/2008 Feng ..... B24B 37/20 451/59

(Continued)

*Primary Examiner* — Robert Rose
(74) *Attorney, Agent, or Firm* — Bacon & Thomas, PLLC

(57) ABSTRACT

A polishing pad for surface planarization is made by impregnating a polyester-based fibrous fabric with thermosetting resins to form a porous impregnated material, and heating the porous impregnated material to effect changes in shape of the pores such that an integrally formed polishing pad with hard/soft layers of different hardnesses is obtained; the heated side of the polishing pad has high hardness and high cutting/grinding ability, whereas the unheated side maintains the original tiny pores and low hardness; and the polishing pad can produce a buffering effect when subjected to an external force and in turn apply an evenly distributed force to an article being polished.

12 Claims, 3 Drawing Sheets

(56) References Cited

U.S. PATENT DOCUMENTS

| | | | | |
|---|---|---|---|---|
| 2008/0268227 | A1* | 10/2008 | Feng | B24B 37/24 428/316.6 |
| 2011/0003536 | A1* | 1/2011 | Feng | B24B 37/24 451/41 |
| 2012/0302142 | A1* | 11/2012 | Feng | B24B 37/24 451/59 |

* cited by examiner

COMPOSITE POLISHING PAD HAVING LAYERS WITH DIFFERENT HARDNESS AND PROCESS FOR PRODUCING THE SAME

BACKGROUND OF THE INVENTION

1. Field of the Invention

The present invention relates to a polishing pad and a process for producing the same, and more particularly relates to an improved composite polishing pad has layers with different hardnesses and is so suitable for use in chemical-mechanical planarization (CMP) of semiconductor wafer, and a process for producing the polishing pad.

2. Description of Related Art

Chemical mechanical polishing (CMP) is typically used in a wafer planarization process to smooth the surface of a wafer so that the roughness and flatness of the wafer surface meet quality requirements. During the polishing process, the rough surface of a polishing pad, over which a polishing fluid is evenly distributed, is rotated on and makes frictional contact with the wafer surface, in order for the microparticles in the polishing fluid to grind the wafer surface and thereby produce the intended chemical reaction for flattening the wafer surface.

Both polishing pads and polishing fluids for use in CMP are consumables. When a polishing pad has been used for a while, its polishing (i.e., rough) surface is very likely to be uneven because it has been worn by wafer surfaces in frictional contact with it. If this worn polishing pad is still used in a CMP planarization process, not only the polishing speed but also the polishing result will be compromised, leaving the polished wafer surfaces with undesirable flatness.

A polishing pad or polishing surface made of a fibrous fabric impregnated with a polyurethane (PU) resin has relatively low hardness, relatively low porosity, and consequently a poor planarization effect. Lacking a substrate with a high-hardness and high-porosity surface and a highly compressible bottom layer, such a pad structure does not possess the physical properties generally required for CMP. More specifically, the polishing surface of such a pad structure tends to be uneven due to non-uniform distribution of the ingredients of the substrate, thus impairing the CMP effect and efficiency. The use of such pad structures is therefore limited.

In view of the above, one technical means to increasing the flatness of a wafer surface is to use a polishing pad with an abrasion-resistant high-porosity rough surface and a highly compressible (or buffering) bottom layer for maintaining the flatness of the rough surface after long-term use without any adverse effects on the polishing speed of CMP operation.

Nowadays, polishing pads in common use can be generally categorized as one-layer or composite. One-layer polishing pads are disadvantaged by their having only the rough surface, impregnated with a PU resin for example. Even though more advanced versions with an abrasion-resistant high-porosity rough surface have been developed, e.g., with a rough surface impregnated with a PU foam, the pads themselves are still not highly compressible and hence fail to provide the desired buffer function. Moreover, it is difficult to control the pore size of the foam and much more difficult to control the distribution of pores. When used in a CMP operation, this kind of polishing pads will have problem keeping the flatness of their rough surfaces; as a result, the flatness of the polished wafer surfaces falls short of quality requirements.

Composite polishing pads, on the other hand, have a stacked structure composed of at least two different polishing substrates. For example, the upper layer of a two-layer polishing pad is a relatively hard polishing substrate, has an abrasion-resistant high-porosity rough surface, and serves as an incompressible polishing layer while the lower layer is a relatively soft polishing substrate, features high compressibility, and functions as a buffer layer for keeping the flatness of the rough surface of the upper polishing layer.

In U.S. Pat. No. 5,287,663, Pierce et al. disclose a CMP pad formed by bonding together three layers of different materials. A top layer is a relatively incompressible polishing layer attached to a middle rigid layer. The middle rigid layer is formed of an incompressible material in order to provide rigidity and is disposed on a bottom resilient layer. The resilient layer is made of a compressible material in order to impart resilience to the rigid layer.

The drawbacks of such composite polishing pads stem from the fact that their multilayer pad structure is not integrally formed but is constructed by bonding the working layers with intervening adhesive layers. During a CMP operation, the adhesive layers between the working layers are subject to shear forces caused by friction and may therefore be torn or peeled off, and the polishing layer of a polishing pad with dislodged adhesive layers cannot maintain a flat rough surface, let alone produce wafer surfaces of the required flatness.

Another type of composite polishing pads includes a polishing layer embedded with a buffer layer made of a compound with rubber elasticity, wherein the buffer layer has a smaller storage modulus than the polishing layer. As the buffer layer is formed inside the polishing layer, the properties of the polishing layer must be taken into account, which imposes limitations on the selection the buffer layer. Furthermore, the manufacture of such a polishing pad involves a complicated process.

SUMMARY OF THE PRESENT INVENTION

It is an object of the invention to overcome aforementioned problems regarding a prior used composite polishing pad needed to bond a polishing layer and a buffer layer with adhesive, and further solving such a prior used composite polishing pad associated with another problem regarding its polishing layer providing with a low compressibility and insufficient buffering ability.

It is still an object of the invention to provide an improved composite polishing pad for use in a CMP planarization processing, whose structural feature is favorable to increase hardness by adding a polyvinyl chloride (PVC) resin into a PU resin, and further mixing with an appropriate amount of inorganic powder.

It is another object of the invention to provide an improved composite polishing pad is ideal for surface planarization of semiconductor wafer, since the composite polishing pad possesses both high hardness (higher than 88 on the Asker C scale) and high compressibility (with a compression rate higher than 3.5%).

It is still another object of the invention to provide a process for producing the improved composite polishing, comprising impregnating a polyester-based fibrous fabric with a specific resin solution to form a prepreg of a porous resin substrate; partially melting the porous resin substrate with a heat treatment on one side or on both sides to allow the porous resin to be changed as a modified porous resin with very stiff large pores in structure due to heat treatment processing on the heated side; and, no using adhesive, after completion of the heat treatment, the final composite polishing pad of the present invention has hard/soft layers formed as an integral structure is obtained.

It is still another object of the invention to provide an improved composite polishing pad, whose entire cross section has hard/soft layers with different hardnesses, wherein the hard layer of the composite polishing pad is formed from very stiff large pores, and the soft layer of the composite polishing pad is formed from mild tiny pores.

It is still another object of the invention to provide a process for producing an improved composite polishing pad for use in surface planarization processing, comprising the following steps of:

1) A thermosetting resin solution for impregnation is prepared; of which composition is composed of:
   a) resins at 12.5-22 wt %, including a PU resin and a PVC resin, wherein the PU resin makes up 70-95 wt % of the resins while the PVC resin makes up the rest;
   b) a N,N-dimethylformamide (DMF) aqueous solution at 60-85 wt %;
   c) surfactants at 2-12 wt %;
   d) an anti-foaming agent at 0.1-1 wt %;
   e) a water repellant at 0.1-3 wt %;
   f) a plasticizer at 0.1-3 wt %;
   g) inorganic powder at 0.1-3 wt %; and
   h) a stabilizer at 0.1-2 wt %;
2) Fibrous fabric with an appropriate thickness is chosen to impregnate with the thermosetting resin solution of step 1);
3) The resin in the impregnated fibrous fabric of step 2) is allowed to flocculate, before the impregnated fibrous fabric is washed;
4) The washed impregnated fibrous fabric of step 3) is heated on one or both sides with an infrared (IR) heating tube or an electric heating plate for heating processing, preferably using a medium-wave twin tube infrared emitter, under temperature of 180-230° C. for 8-180 seconds;
5) After heating processing of step 4), the skin, where is on the heated side of the impregnated fibrous fabric of step 4), has formed with a layer of flocculated PU:
6) To remove the skin from the fibrous fabric of step 5) by cutting and grinding to obtain a composite polishing pad having a target thickness.

The target thickness of the finished composite polishing pad has a thickness between 0.45 mm and 4.0 mm, preferably between 0.8 mm and 4.0 mm, while the thickness of the original fibrous fabric is greater than the target thickness by 5-20%. Once the washed impregnated fibrous fabric is heated, the heated side or sides show an increase in both porosity and hardness and can therefore serve as a high-hardness and high-porosity polishing layer, which is effective in cutting and grinding and whose large pores help discharge debris. The thickness of the polishing layer is at least 0.3 mm thick, preferably at least 0.5 mm thick. The unheated side, if any, maintains the original tiny pores and relatively low hardness and therefore has high compressibility, which leads to a good buffer function. This buffer layer is at least 0.15 mm thick, preferably at least 0.3 mm thick.

Thus, the present invention introduces an integral polishing pad having an excellent cutting and grinding function as well as a good buffer function for use in a CMP planarization processing, and also teaches a process for producing the polishing pad is simpler and more efficient in comparison with the prior art.

DETAILED DESCRIPTION OF THE INVENTION

Figure 1:
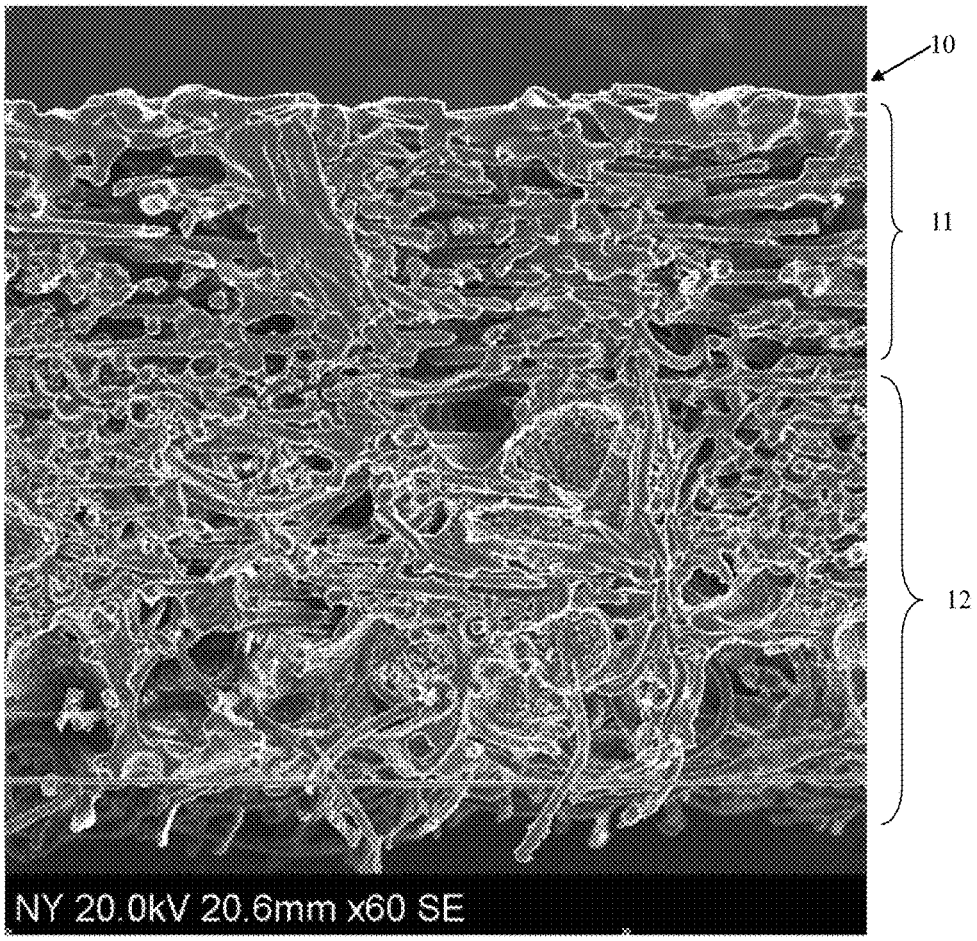
FIG. 1 is a sectional view of an improved composite polishing pad of the present invention, showing that the composite polishing pad has two layers of different porous materials with different hardnesses.

As shown in FIG. 1, the present invention disclosed an improved composite polishing pad 10 whose entire cross sectional structure is an integral porous material (or called porous resin substrate), and more particularly, of which cross sectional structure appears layered effects and seems to at least comprise two layers of different porous material layered up together, but each layer provides with different pores size and different hardness.

Therefore, the entire cross section of the composite polishing pad 10 of the present invention, being formed as an integral structure, possesses characteristics of hardened hardness as well as softened hardness simultaneously.

Carefully observed an entire cross section of a specific example shown in FIG. 1, the composite polishing pad 10 of the present invention is no use of adhesive to have two layered porous materials layered up together as an entire cross sectional structure, and one layer of them provides different pores size and different hardness with the other.

More specially, the composite polishing pad 10 of the present invention in FIG. 1 has an entire cross sectional structure formed from an upper layer served as a polishing layer 11 and a lower layer served as a buffer layer 12. The polishing layer 11 provides a physical property with a highly hardness as well as a lower compressibility. Conversely, the buffer layer 12 provides another physical property with a highly compressibility as well as a tenderly hardness.

Such that, the polishing layer 11 due to being formed as the upper layer has an abrasion-resistant high-porosity rough surface for cutting and grinding; on the other hand, the buffer layer 12 due to having highly compressibility and being formed as the lower layer plays a functional role like a cushion pad capable of absorbing vibration arisen from cutting and grinding as well as supporting the upper layer of polishing layer 11 to allow its abrasion-resistant high-porosity rough surface to be kept in flatness for cutting and grinding. Accordingly, the composite polishing pad 10 of the present invention is so suitable to use in a CMP planarization process for flattening the wafer surface.

The composite polishing pad 10 of the present invention is a porous resin substrate which is made by, inter alia, performing a flocculation process on a fibrous fabric.

A process for producing the composite polishing pad 10 of the present invention disclosed herein is that a fibrous fabric is filled with a thermosetting resin composition to form as an impregnated fibrous fabric, which is subsequently flocculated in water (or DMF solution) to form as a porous resin substrate. Afterwards, a process for heat treatment is performed by heating the porous resin substrate on one side (or both sides) to obtain the composite polishing pad 10 of the present invention.

The fibrous fabric is preferably chosen to have a density ranging from 0.1 to 0.5 g/cm$^3$, and the original thickness of the fibrous fabric should be greater than the target thickness of the composite polishing pad 10 by 5-20%.

Generally, flocculated resin is flocculated with highly porous and is relatively much softer in touch. The process for producing the composite polishing pad 10 of the present invention is followed by the following steps to achieve some desired properties:

1) taking a fibrous fabric; and choosing a resin mixture with appropriate melting point and hardness;
   A suitable resin mixture is a mixture of polyester-based or polyether-based PU resin, emulsion-polymerized PVC powder, an acrylic resin, an epoxy resin, and so on.
2) preparing a solution containing the chosen resin mixture, of which solid content being 8-30 wt %, preferably 10-25 wt %, based on the total weight of the solution; and allowing the solution to be filled into the chosen fibrous fabric through an impregnating process;
3) making the resin mixture filled into the fibrous fabric to be flocculated in water or an appropriate N,N-dimethylformamide (DMF) aqueous solution, whose DMF concentration is about 10-30 wt %, preferably 15-25 wt %;
4) washing the flocculated fibrous fabric of step 3), and then drying the same;
5) heating the flocculated fibrous fabric of step 4) on one side or both sides up to having a temperature increased to higher than the melting points (Tm) of the resins filled into the fibrous fabric, through the resins being melted and re-solidified again, to improve those resin's structure form a harder structure with more large pores.

More specially, the composition of the chosen resin mixture of the present invention, based on the total weight of the chosen resin mixture, include the following components:

a) resins at 12.5-22 wt %, including a PU resin and a PVC resin mixed together as main ingredients of the resin mixture, wherein the PU resin makes up 70-95 wt % of the resins while the PVC resin makes up the rest (i.e., 30-5 wt %);
b) a N,N-dimethylformamide (DMF) solvent at 60-85 wt %, to increase the flowability and workability of the resins;
c) surfactants at 2-12 wt %, to accelerate washing, increase the elasticity of the PU resin, and enhance pore structure uniformly formed on the PU resin;
d) an anti-foaming agent at 0.1-1 wt %, to reduce the number of bubbles, which may hinder complete impregnation of the fibrous fabric with the resin solution, because incomplete impregnation gives rise to pore defects;
e) a water repellant at 0.1-3 wt %, to impart water repellency to the resin composition;
f) a plasticizer at 0.1-3 wt %, to lower the melting points of the resins so that the resins can be easily melted and then re-solidify to form a harder structure with more large pores;
g) inorganic powder at 0.1-3 wt %, to enable better thermal conduction and provide the polishing layer of the present invention with high hardness; and
h) a stabilizer at 0.1-2 wt %, preferably a liquid-state phenol-free calcium-zinc stabilizer, the purpose of using the stabilizer is that the manufacturing process is free of phenol-based solvents, and this allows the polishing substrate of composite polishing pad of the present invention to have higher resistance to heat during a polishing operation.

For more detailed description, the resins including a PU resin at 70-95 wt % and a PVC resin at 5-30 wt % and formed as main ingredients of 12.5-22 wt % of the chosen resin mixture of the present invention will eventually help the composite polishing pad of the present invention to have high hardness, high compressibility, and good buffering ability.

The PU resin is capable of being obtained by reacting an organic isocyanate compound with a polyol compound.

The organic isocyanate compound may be an aliphatic, aromatic, or alicyclic diisocyanate. Specific example of the organic isocyanate compound is one or more compounds selected from the group consisting of trimethylhexane methylene diisocyanate, isophorone diisocyanate, hexamethylene diisocyanate, 4,4'-diphenyl methane diisocyanate, 4,4'-diphenyl diisocyanate, and a mixture of the above.

The polyol compound is polyester-based polyol or polyether-based polyol. The polyether-based polyol may be a polyalkylene ether glycols formed by ring-opening polymerization of an ethylene oxide, a 1,2-propylene oxide or a tetrahydrofuran; and the polyester-based polyol is formed by reacting an aliphatic dicarboxylic acid with an aliphatic alcohol, wherein the aliphatic dicarboxylic acid is selected from a succinic acid, a glutaric acid, a suberic acid, or an adipic acid; and the aliphatic alcohol is selected from an ethyleneglycol, a triethyleneglycol, or a neopentyl glycol.

The PVC resin used to mix with the above-mentioned PU resin includes a vinyl chloride (VC)-vinyl acetate (VA) copolymer (abbreviated as VC-VA copolymer) used in conjunction with emulsion-polymerized PVC powder having a different average degree of polymerization.

An appropriate amount of VC-VA copolymer and an appropriate amount of emulsion-polymerized PVC powder having a different average degree of polymerization can make a highly compressible porous material (e.g. the above-mentioned buffer layer 12) with good buffering ability.

The VC-VA copolymer makes up 30-80 wt % of the PVC resin and is the product of copolymerizing vinyl chloride and vinyl acetate monomers. The higher the vinyl acetate content is, the more adhesive the VC-VA copolymer has. In fact, a VC-VA copolymer with high vinyl acetate content attaches to the fibrous fabric so well that the polishing layer 11 and the buffer layer 12 are bonded together without additional adhesive. The vinyl acetate content, therefore, should be chosen properly. The VC-VA copolymer, featuring the high toughness and corrosion resistance of vinyl chloride and the high adhesiveness and plasticity of vinyl acetate, is used in a resin solution to form a porous polishing substrate that is dimensionally stable and can resist the high temperature of a polishing operation.

The emulsion-polymerized PVC powder includes both high-molecular-weight (HMW) and low-molecular-weight (LMW) emulsion-polymerized PVC powder. The high-molecular-weight emulsion-polymerized PVC powder has an average degree of polymerization (DP) ranging from 1650 to 1850 and a Fikentscher's constant ranging from 77.2 to 81 and accounts for 20-40 wt % of the PVC resin. The low-molecular-weight emulsion-polymerized PVC powder makes up 0-30 wt % of the PVC resin (to be adjusted according to the intended viscosity of the resin solution) and has an average degree of polymerization ranging from 1350 to 1550 and a Fikentscher's constant ranging from 73.0 to 76.5.

The solvent used in the resin composition of the present invention is an organic solvent, typically N,N-dimethylformamide (DMF) or N,N-dimethylacetamide (DMA), and makes up 60-85 wt %. The solvent is miscible with water, ether, alcohols and is used to adjust the viscosity and solid content of the mixed resin solution, in order for the solution to have good flowability and workability, with a working viscosity ranging from 500 to 5000 cps, preferably from 1000 to 2500 cps.

The surfactants added in the chosen resin mixture (or called resin composition) of the present invention serve to increase the structural strength and elasticity of the resins and to accelerate washing.

Depending on the desired pore sizes of the porous resin substrate, the surfactants generally include an anionic surfactant and a non-ionic surfactant and make up 2-12 wt % of the resin composition. The anionic surfactant leads to a porous layer (e.g. the above-mentioned polishing layer 11) with large pores and is added at 1.5-10 wt %. The non-ionic surfactant results in a denser porous layer and is added at 0.5-5 wt %. A combination of both surfactants contributes to uniform porosity.

The anionic surfactant is one or more surfactants selected from the group consisting of ammonium lauryl sulfate, triethanolamine lauryl sulfate, sodium lauryl sulfate, ammonium laureth sulfate, sodium laureth sulfate, ammonium nonylphenol ether sulfate, and sodium lauroyl glutamate.

The non-ionic surfactant is one or more surfactants selected from the group consisting of polyoxy ethylene nonyl phenyl ether, polyethoxylated aliphatic linear alcohol, and polyethoxylated glycol.

The water repellant added in the resin composition of the present invention serves to lend hydrophobicity to the PU resin so that the finished product is enhanced in water resistance (i.e., being water-repellent during a polishing operation) and dimensional stability (i.e., being able to retain its dimensions even when soaked in a polishing liquid for a long time), which improvement can be obtained by adding the water repellant to the flocculated resins.

Water repellants applicable to the present invention include commercially available water/oil repellants that are suitable for use with fibers. More specifically, the water repellant may be selected from, or be a mixture of, a silicone-based treating agent, a fluorine-based water repellant, and a branched hydrophobic alkyl-modified PU dendrimer.

A branched hydrophobic alkyl-modified PU dendrimer, such as BIONIC-FINISH®ECO supplied by RUDOLF, is made by gradually combining multifunctional-group monomers into a high-density silicon-free fluorine-free product with hydrophobic groups. The water repellant is added at 0.1-3 wt %.

The inorganic powder in the resin composition of the present invention is added at 0.1-3 wt %. The inorganic powder is intended to control the amount of heat conducted to the above-mentioned polishing layer 11 and the above-mentioned buffer layer 12 while the impregnated fibrous fabric is heated with an IR heating tube or electric heating plate, thereby controlling the pore sizes of those layers.

If the inorganic powder makes up less than 0.1 wt % of the resin composition, the impregnated fibrous fabric will not have the desired thermal conductivity after heat treatment, and separation between the polishing layer 11 and the buffer layer 12 will be less pronounced. If the inorganic powder is added at a percentage higher than 3 wt %, the physical properties of the resin composition and impregnation with the resin composition will be adversely affected.

The inorganic powder may be one or more powders selected from the group consisting of spherical or irregular $SiO_2$, $TiO_2$, $Al(OH)_3$, $Mg(OH)_2$, $CaCO_3$, and fumed silica. The inorganic powder preferably has an average particle size ($D_{50}$) ranging from 0.01 to 20 μm, more preferably from 0.1 to 20 μm, even more preferably from 0.1 to 10 μm.

When fibrous powder is used, the fiber diameter of the powder should be 0.1-10 μm, with a fiber length-to-fiber diameter ratio greater than 2. Preferably, the fiber diameter is 0.1-5 μm, and the fiber length-to-fiber diameter ratio is greater than 5. A fiber diameter greater than 10 μm may have adverse effects on the appearance of the finished product.

The stabilizer in the resin composition of the present invention is a phenol-free calcium-zinc stabilizer in the form of a liquid and is added at 0.1-2 wt %.

More specifically, the stabilizer contains none of the following three solvents: nonyl phenol, bisphenol A, and phenol. The absence of phenol-based solvents in the manufacturing process enables the porous resin substrate of the present invention to be more resistant to heat during the polishing process.

The melting points of the resins used in the present invention play a crucial role because the temperature of heat treatment is closely related to the melting points. The heating temperature must be higher than the resin melting points to ensure that the resins melt and re-solidify. The melting points of the resins are preferably 140° C. or higher.

The resins will not melt and re-solidify if the heating temperature is too low. The melting points of the resins must not be lower than a temperature of 140° C.; otherwise, the resins may soften significantly due to the heat generated in a polishing operation.

The fibrous fabric used in the present invention has a sufficiently high softening temperature, so the heat causing the resins to melt and re-solidify will not significantly soften or melt the fibers of the fabric. The fibrous fabric is preferably made of polyester fibers.

In addition, the washing step is critical to the preparation of the porous material or the porous resin substrate of the present invention. The small amount of DMF solvent left from the resin flocculation step will have adverse effects on the properties of the resins while the resins are melting and re-solidifying. More specifically, the residual solvent, which is distributed unevenly, may bring down the melting points of the resins and produce discolored spots on the finished product. To eliminate such drawbacks and provide enhanced water-washability, the present invention adds surfactants to the flocculated resins. Applicable surfactants as mentioned above include an anionic surfactant, a non-ionic surfactant, or a mixture of both.

In a CMP planarization processing, to ensure that the finished product (or the composite polishing pad 10) functions stably and is not subject to changes in dimension when soaked in a polishing liquid for a long time, the present invention uses water repellant added to the flocculated resins.

The water repellant in the resin composition of the present invention is added at 0.1-3 wt %, which water repellant is selected from a silicone-based treating agent, a fluorine-based water repellant, a branched hydrophobic alkyl-modified PU dendrimer, or a mixture of the three compounds.

The silicone-based treating agent may be a silane-based compound or a siloxane-based compound. The fluorine-based water repellant may be selected from poly(1,1-dihydro-fluoroalkyl acrylate) and fluoroalkyl methacrylates. A branched hydrophobic alkyl-modified PU dendrimer (e.g., BIONIC-FINISH®ECO of RUDOLF) is made by gradually combining multifunctional-group monomers into a high-density silicon-free fluorine-free product with hydrophobic groups.

Heat treatment is the most sensitive step in the present invention. The heating temperature is set at 180-230° C. A lower temperature setting will require a longer heating time. For industrial production, the heating temperature is preferably 190-230° C. Insufficient heating will be unable to soften the resins, let alone provide the desired porosity and hardness. Overheating, on the other hand, will cause deterioration of the resins and may damage the resin/fiber structure.

During the heat treatment, the fibers, which have a relatively high melting point, keep their original structure to serve as a support, and the resins, which have relatively low melting points, melt and then re-solidify to improve the sectional structure and hardness. Consequently, the strength and hardness of the finished polishing substrate are achieved.

The heat treatment of the present invention can be performed by any conventional method capable of softening and melting resin in a fiber network and then allowing the resin to re-solidify. Currently preferable heat treatment methods include heating by radiation, heating by a heating plate, heating by a hot-air furnace, and heating by a hot-air knife. The heat treatment, however, is not limited to the foregoing means.

Another way to improve the resin properties through the heat treatment is to add a small amount of ester-based plasticizer to the flocculated resins. For example, diisononyl phthalate (DINP) or tri(2-ethylhexyl) trimellitate (TOTM) can be added to lower the melting points of the resins and thereby allow the heat treatment temperature to be lowered.

FIG. 1 is a sectional view of the composite polishing pad 10 being a preferred embodiment of the present invention. The composite polishing pad 10 being a porous material product shows to have an integrally formed structure with increasingly harder layers. In this scanning electron microscope (SEM) photograph, it can be seen that the cross sectional structure of the polyester fiber of porous material or porous resin substrate has changed noticeably after the heat treatment.

More specifically, the composite polishing pad 10 shown in the photograph has a two-layer structure, having a thickness between 0.45 mm and 4.0 mm, preferably between 0.8 mm and 4.0 mm, and comprising an upper half as a polishing layer 11 and a lower half as a buffer layer 12. The thickness of the polishing layer 11 is at least 0.3 mm thick, preferably at least 0.5 mm thick. This buffer layer is at least 0.15 mm thick, preferably at least 0.3 mm thick.

The upper half of the polishing layer 11 corresponds to the heated side of the composite polishing pad 10 and has large pores and high hardness resulting from an increase in both porosity and hardness thanks to the melting and re-solidification of the resins, and the lower half of the buffer layer 12 corresponds to the unheated side of the composite polishing pad 10 that is not directly heated and that maintains the original tiny pores and relatively low hardness and therefore has high compressibility, which leads to a good buffer function.

In this embodiment, the fibrous fabric had a plurality of pores and tiny gaps after the resin flocculation step and was subsequently heated to effect structural changes in the porous material.

More specifically, both porosity and hardness of the heated side of the porous material or the porous resin substrate were increased, so the polishing surface (e.g. the above-mentioned polishing layer 11) of the porous material or the porous resin substrate had high hardness, large pores and hence the desired cutting and grinding ability.

Conversely, the unheated side of the porous material or the porous resin substrate, however, maintained the original tiny pores and low hardness and was capable of producing a buffering effect by allowing uniform distribution of pressure during a polishing operation.

That is to say, the heat treatment gives the porous material or the porous resin substrate of the present invention a gradation of hardness within its structure. The upper half of the structure formed as the above-mentioned polishing layer 11 which corresponds to the heated side of the thermosetting resins and has large pores and high hardness due to an increase in porosity and hardness as the resins melt and re-solidify. During a polishing operation, therefore, this half of the structure features a high cutting rate and high flatness. And, the lower half of the structure formed as the above-mentioned buffer layer 12 is not heated directly such that the original tiny pores and low hardness remain, allowing this part of the structure to buffer large stresses, distribute the polishing pressure evenly, and thereby protect the article being polished from breaking during the polishing process. Thus, the porous material or the porous resin substrate of the present invention has the features of a composite polishing pad with hard and soft layers.

As teaching by the present invention, the heat treatment is performed by heating the porous material or the porous resin substrate on one side under temperature of 180-230° C. for 8-180 seconds. When the porous material or the porous resin substrate of the present invention is heated to a sufficiently high temperature, some of the resin substrate melts and then re-solidifies. The resins flow during the melting and re-solidifying process such that tiny pores begin to disappear. Since the molten resins tend to re-solidify in the vicinity of the fibers which are used to weave a fibrous fabric, relatively large pores are formed, and the hardness of the heated side of the porous material or the porous resin substrate is increased with the size and number of the large pores, due to undergoing a significant change in configuration.

On the contrary, due to none heating process for melting and re-solidifying the resins being happened, the other unheated side of the porous material or the porous resin substrate is only started with a plurality of tiny pores as well as a large surface area of resins, and then obtained relatively low hardness.

After completion of the heat treatment, the molten resins in the porous material or the porous resin substrate are bonded to the fibers, the original tiny pores become larger pores, the surface area of the resins is reduced, and the hardness of those reticulated resin's structure is increased. As for the unheated side, where the temperature is not high enough to melt the resins, the original tiny-pore low-hardness structure remains. Thus, the heating method of the present invention produces a structure with a gradation of hardness.

The present invention provides a process for producing a porous material or a porous resin substrate to be used as the composite polishing pad 10 of the present invention for use in surface planarization processing, and the following physical properties and features of some porous materials or porous resin substrates thus made were evaluated by their respective methods as stated below.

1. Thickness of a large- or tiny-pore layer consisting in a tested porous resin substrate:
   To make a measurement is in accordance with a handheld thickness meter.
2. Asker C hardness:
   In accordance with the test method using a type C hardness tester specified in JIS K7312.
3. Compression rate or compressibility:
   Compression rate [%]=(T1−T2)/T1×100. A pressure of 300 g/cm$^2$ is applied to a polishing pad (or porous resin substrate) for 1 minute, and then first pad thickness T1 is measured. Subsequently, the pressure is increased sixfold to 1800 g/m$^2$ and applied for another 1 minute, second pad thickness T2 is measured. The values of T1 and T2 are substituted into the said equation to determine the compression rate of the polishing pad.
4. Sectional features:
   SEM photographs are taken in order to observe pore arrangement in a cross section of a polishing pad and measure the thickness of each layer identified.
5. Buffering effect of a polishing pad:
   It is assessed according to such incidents as a wafer broken while being polished with a polishing machine, and an abnormal amount of scratches.
6. Flatness of a polished wafer:
   The edges of a polished wafer are observed with a scanning electron microscope. The less rounded the edges, the better.

To begin with, thermosetting resin solutions S1-S8 were prepared in a total of eight preparation examples.

In each preparation example, the PU resin was dissolved in N,N-dimethylformamide (DMF) to produce a resin solution with 30% solid content. The formula of each preparation example is shown in Table 1.

In preparation example 1, for instance, the ingredients were added in the following order. First, 41 g of DMF was poured into a reaction tank. Then, 50 g of the PU resin solution with 30% solid content was added, and a stirring blades installed into the reaction tank were activated to rotate at low speed until complete dissolution was achieved. After that, 1.5 g of VC-VA copolymer (copolymer powder C-15 of Formosa Plastics, Taiwan) and 0.5 g of emulsion-polymerized PVC powder (PR1069 of Formosa Plastics, Taiwan) were added and allowed to dissolve completely, followed by 0.5 g of tri(2-ethylhexyl) trimellitate (TOTM), serving as a plasticizer, while stirring continued. Then, 4 g of surfactants (including 2.5 g of ammonium lauryl sulfate-based anionic surfactant and 1.5 g of polyoxy ethylene nonyl phenyl ether-based non-ionic surfactant), 0.2 g of anti-foaming agent (BYK011 of BYK, Germany), 1 g of water repellant (BIONIC-FINISH®ECO of RUDOLF, Germany), 1 g of inorganic $SiO_2$ powder (with an average particle size $D_{50}$ of 0.01-10 μm), and 0.3 g of liquid-state calcium-zinc stabilizer (LCX-42P of Nan Ya Plastics, Taiwan) were added. The mixture obtained was identified as resin solution S1.

Based on the same method, resin solutions S2-S8 were prepared according to their respective formulae in Table 1.

TABLE 1

Resin solution formulae

| | | Preparation example | | | | | | | |
|---|---|---|---|---|---|---|---|---|---|
| | | 1 | 2 | 3 | 4 | 5 | 6 | 7 | 8 |
| Resin solution code | | S1 | S2 | S3 | S4 | S5 | S6 | S7 | S8 |
| PU resin solution (30% solid content) | PU resin (g) | 15 | 15 | 14.7 | 13.5 | 13.5 | 13.2 | 14.7 | 15.9 |
| | Solvent, DMF (g) | 35 | 35 | 34.3 | 31.5 | 31.5 | 30.8 | 34.3 | 37.1 |
| | subtotal (g) | 50 | 50 | 49 | 45 | 45 | 44 | 49 | 53 |
| PVC resin | VC-VA copolymer*1 (g) | 1.5 | 1.2 | 1.9 | 2.5 | 3.0 | 3.0 | 1.0 | — |
| | HMW emulsion-polymerized PVC powder*2 (g) | 0.5 | 0.8 | 0.8 | 1.5 | 1.0 | 1.2 | 0.5 | — |
| | LMW emulsion-polymerized PVC powder*3 (g) | — | — | 0.3 | — | 1.0 | 0.75 | — | — |
| Plasticizer, TOTM (g) | | 0.5 | 0.5 | 1 | 2 | 2 | 2 | 1 | — |
| Solvent, DMF (g) | | 41 | 41 | 40 | 41 | 40 | 40 | 40 | 40 |
| Surfactants | Anionic surfactant*4 (g) | 2.5 | 2.5 | 3 | 3 | 3 | 3.3 | 3.5 | 3 |
| | Non-ionic surfactant*5 (g) | 1.5 | 1.35 | 1 | 1 | 1.5 | 1.5 | 1.1 | 1.3 |
| Anti-foaming agent (g) | | 0.2 | 0.2 | 0.2 | 0.2 | 0.2 | 0.2 | 0.2 | 0.2 |
| Water repellant (g) | | 1 | 1 | 1.5 | 1.5 | 2 | 2 | 2.5 | 2 |
| Inorganic powder (g) | | 1 | 1 | 1 | 1.3 | 1 | 1 | 1 | 0.5 |
| Calcium-zinc stabilizer (g) | | 0.3 | 0.45 | 0.3 | 1 | 0.3 | 1 | 0.2 | — |
| Total (g) | | 100 | 100 | 100 | 100 | 100 | 100 | 100 | 100 |

Note *1:
copolymer powder C-15 supplied by Formosa Plastics Corporation; this VC-VA copolymer contains 13.0% vinyl acetate and has a Fikentscher's constant of 50.
Note *2:
emulsion-polymerized PVC powder PR1069 supplied by Formosa Plastics Corporation, with a Fikentscher's constant ranging from 77.5 to 81.
Note *3:
Emulsion-polymerized PVC powder PR415 supplied by Formosa Plastics Corporation, with a Fikentscher's constant ranging from 73.0 to 76.5.
Note *4:
ammonium lauryl sulfate-based anionic surfactant.
Note *5:
polyoxy ethylene nonyl phenyl ether-based non-ionic surfactant.

The following Examples are provided to demonstrate the present invention in more detail. To start with, resin solutions were prepared as in the foregoing preparation examples. In Examples 1-14 or Comparative Examples 1-4, referring to Tables 2-4, a 1.8 mm thick or 3.6 mm thick fibrous fabric was made of short polyester fibers by a needle felting technique, impregnated with resin solution S1-S8, and subjected to the aforesaid flocculation, washing, and drying steps.

Example 1

A 1.8 mm thick fibrous fabric impregnated with resin solution S1 was fed into an embossing machine for heat treatment, where the fibrous fabric was heated on one side with a medium-wave twin tube infrared emitter (abbreviated as IR heating tube) having a tube diameter of 18×8 mm.

The heating conditions of the embossing machine are as follows: the IR heating tube provided a gradated increase in temperature and had a power density of 20 W/cm; the embossing machine has a heat treatment cabinet being 1.2 m long, of which processing speed is controlled at 5 meter per minute (i.e., 5 m/min), under heating temperature of 230° C. for heating of 14.4 seconds.

Afterwards, the fibrous fabric was allowed to cool, and the skin of the impregnated fibrous fabric was subsequently removed by cutting and grinding to produce a 1.25 mm thick porous material or porous resin substrate.

Shown as the following Table 2, the physical properties and internal structure of this material were determined, including the hardness is equal to 92 (on the Asker C scale, measured with the Asker durometer), the compression rate is equal to 5.2%, and two layers were identified in the cross section, with large pores and tiny pores arranged in a gradated manner.

Example 2

A 1.25 mm thick porous material or porous resin substrate is produced by the same producing process as the Example 1 does, wherein the 1.8 mm thick impregnated fibrous fabric was heated on one side, in addition to the processing speed of the embossing machine being adjusted from 5 m/min to 9 m/min, and the heating time is changed for 8 seconds.

Shown as the following Table 2, the physical properties and internal structure of this material were determined, including the hardness is equal to 91 (on the Asker C scale, measured with the Asker durometer), the compression rate is equal to 5.4%, and two layers were identified in the cross section, with large pores and tiny pores arranged in a gradated manner.

Example 3

A 1.25 mm thick porous material or porous resin substrate is produced by the same producing process as the Example 1 does, wherein the 1.8 mm thick impregnated fibrous fabric was heated on one side, in addition to the processing speed of the embossing machine being adjusted from 5 m/min to 3 m/min, and the heating time is changed for 24 seconds.

Shown as the following Table 2, the physical properties and internal structure of this material were determined, including the hardness is equal to 93 (on the Asker C scale, measured with the Asker durometer), the compression rate is equal to 4.0%, and two layers were identified in the cross section, with large pores and tiny pores arranged in a gradated manner.

Example 4

A 3.0 mm thick porous material or porous resin substrate is produced by the same producing process as the Example 1, in addition to a 3.6 mm thick fibrous fabric impregnated with resin solution S1 was heated on both sides, the processing speed of the embossing machine is controlled at 5 m/min, under heating temperature of 230° C. for heating of 14.4 seconds.

The 3.6 mm thick impregnated fibrous fabric was heated first on one side and then on the other side under the same conditions.

Shown as the following Table 2, the physical properties and internal structure of this material were determined, including the hardness is equal to 91 (on the Asker C scale, measured with the Asker durometer), the compression rate is equal to 5.6%, and three layers were identified in the cross section, with large pores, tiny pores and large pores arranged in a gradated manner.

Comparative Example 1

A 1.8 mm thick fibrous fabric was, impregnated with resin solution S8, subjected to the aforesaid flocculation, washing, and drying steps to produce an impregnated material whose upper and lower surfaces had a skin formed by a flocculated PU layer.

No receiving any heat treatment, after removing the skin by cutting and grinding, a 1.25 mm thick porous material was obtained.

Shown as the following Table 2, the physical properties and internal structure of this material were determined, including the hardness is equal to 81 (on the Asker C scale, measured with the Asker durometer), the compression rate is equal to 5.2%.

Figure 2:
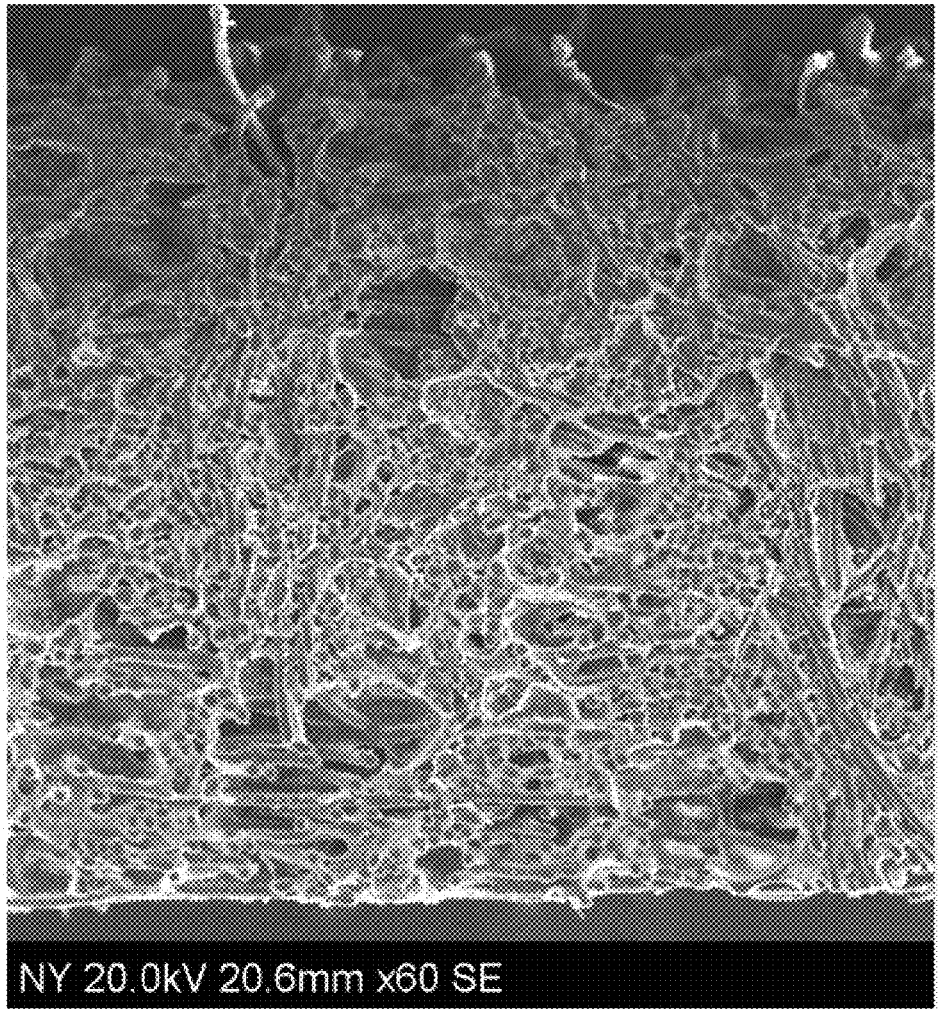
FIG. 2 (prior art)
FIG. 2 is a sectional view of a polishing pad having porous material formed from the comparative example 1, wherein the porous material was made by impregnation with a thermosetting resin solution, without heat treatment, and performed poorly in terms of cutting and grinding.

FIG. 2 is a cross sectional view of the porous material produced from the Comparative Example 1, due to no receiving any heat treatment, the cross section of this material has a single layer with a plurality of tiny pores and low hardness. This porous material is a low-hardness material, when used in a polishing operation, the porous material cut at an undesirably low speed and performed poorly in terms or cutting and grinding.

Comparative Example 2

An impregnated fibrous fabric obtained in the same way as in comparative example 1 was subjected to the flocculation, washing, and drying steps to produce an impregnated material whose upper and lower surfaces had a skin formed by a flocculated PU layer.

This porous impregnated material was heated on both sides with circulated 220° C. hot air for 3 minutes. After that, the material was allowed to cool, and the skin of the material was subsequently removed by cutting and grinding to produce a 1.25 mm thick porous impregnated material.

Shown as the following Table 2, the physical properties and internal structure of this material were determined, including the hardness is equal to 88 (on the Asker C scale, measured with the Asker durometer), the compression rate is equal to 3.2%.

Figure 3:
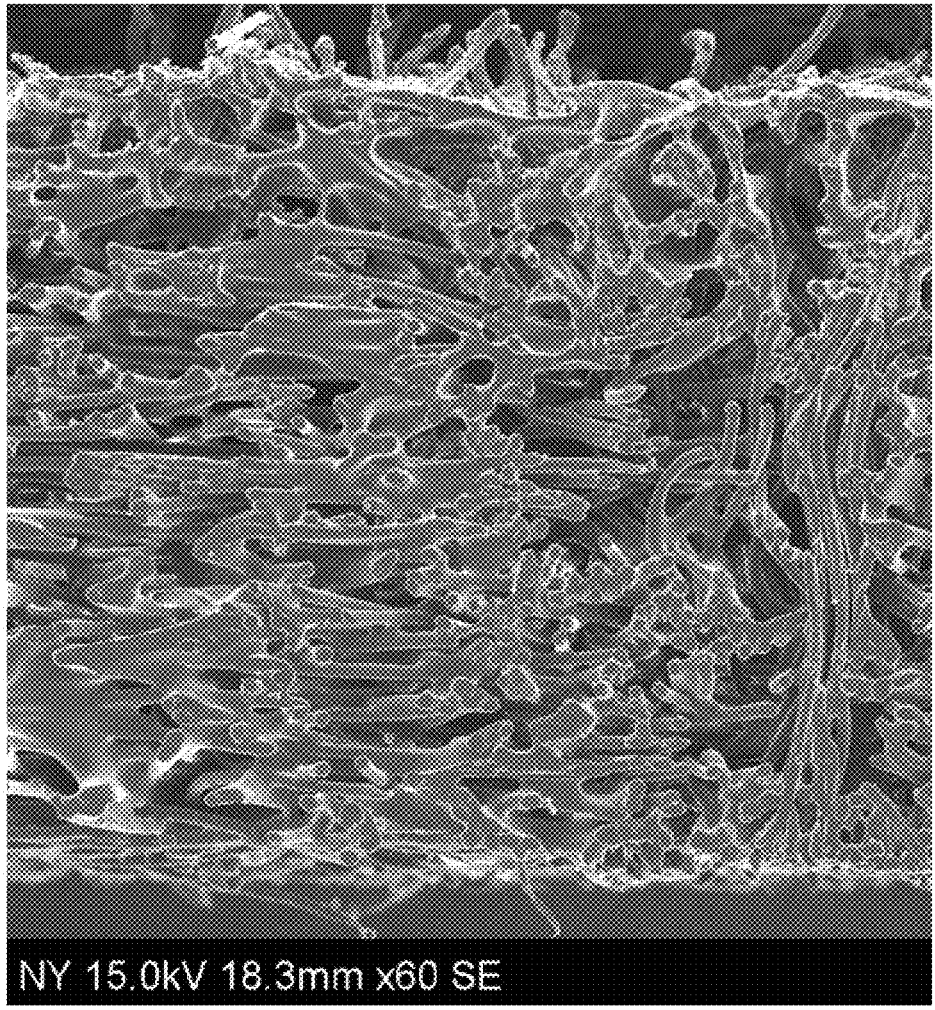
FIG. 3 (prior art)
FIG. 3 is a sectional view of a polishing pad having porous material formed from the comparative example 2, wherein the porous material was heated with 220° C. hot air for 3 minutes and performed poorly in terms of buffering in a polishing operation.

FIG. 3 is a cross sectional view of the porous material produced from the Comparative Example 2, due to having received a heat treatment at 220° C. for 3 minutes, the porous material has a single layer with a plurality of uniform large pores and high hardness.

When used in a polishing operation, this porous material of the Comparative Example 2 has a poor buffering effect, which is failed to buffer polishing pressure sufficiently and caused breakage, and consequently a low yield for the articles polished in a CMP planarization processing.

TABLE 2

Properties of products of Examples 1-4 and Comparative Examples 1-2

| | | Examples No. | | | | Comparative examples | |
|---|---|---|---|---|---|---|---|
| | | 1 | 2 | 3 | 4 | 1 | 2 |
| Resin solution | | S1 | S1 | S1 | S1 | S8 | S8 |
| Thickness of porous reticulated film (mm) | | 1.25 | 1.25 | 1.25 | 3.0 | 1.25 | 1.25 |
| Processing method | Heating means | IR heating tube | | | | None | hot air |
| | Number of heated sides | 1 | 1 | 1 | 2 | 0 | 2 |
| | Processing speed (m/min) | 5 | 9 | 3 | 5 | — | — |
| | Temperature of heating (° C.) | 230 | 230 | 230 | 230 | — | 220 |
| | Heating time (sec) | 14.4 | 8 | 24 | 14.4 | — | 180 |
| Physical properties | Hardness (Asker C) | 92 | 91 | 93 | 91 | 81 | 88 |
| | Compression rate (%) | 5.2 | 5.4 | 4 | 5.6 | 5.2 | 3.2 |
| | Sectional configuration*6 | level #1 | level #1 | level #1 | level #1 | level #2 | level #3 |
| | Pore size on heated side | large pores | large pores | large pores | large pores | — | uniform pores |
| | Pore size on unheated side | tiny pores | tiny pores | tiny pores | tiny pores | uniform pores | — |
| Other features | Thickness of large-pore high-hardness layer (mm) | 0.65 | 0.55 | 1.1 | 0.65 on each side | none | 1.25 |
| | Thickness of tiny-pore low-hardness layer (mm) | 0.6 | 0.7 | 0.15 | 1.7 | 1.25 | none |
| | Number of layers in cross section | two layers | two layers | two layers | three layers*7 | single layer | single layer |
| | Buffering effect of polishing pad | good | good | good | good | good | poor |
| | Flatness of polished wafer | good | good | good | good | poor | good |

Note *6:

level #1 is represent for pores size is gradually arranged from large pores to tiny pores over entire cross section; level #2 is represent for uniform tiny pores are densely distributed over entire cross section; level #3 is represent for uniform large pores are distributed over entire cross section;

Note *7:

the three layers identified in the cross section are sequentially a large-pore layer, a tiny-pore layer, and a large-pore layer.

Conclusion I:

1. Each finished product formed from Examples 1-4 is a 1.25 mm thick porous materials or porous resin substrates, each of which was performed a heat treatment on one side through an IR heating tube.

Consequently, through an IR heating system, those heating conditions including both the processing speed and the heating time for performing a heat treatment may decide the thickness of large-pore layer generated on the final product of porous materials or porous resin substrates; when the processing speed for heat treatment is slower or the heating time is longer, the thickness of large-pore layer formed due to heat treatment is increased; on the contrary, when the processing speed for heat treatment is rapider or the heating time is shorter, the thickness of large-pore layer is reduced.

2. In Examples 1-4, the entire cross section of each finished product showed a layered effect in form of a gradated arrangement of large pores and tiny pores. More specifically, each finished product possesses characteristics of hardened hardness as well as softened hardness simultaneously; on the heated side of each finished product of Examples 1-4 is a high-porosity upper layer with large pores and high hardness, while on the other unheated side is a highly compressible bottom layer with tiny pores and low hardness.

3. After completion of heat treatment on one side for Examples 1-3 or on both sides for Example 4, each finished product of Examples 1-4 is featured not only to have a buffer function with high compressibility ranging from 4.0% to 5.6%, but also on the heated side to have a preferable hardness ranging from 91 to 93 Asker C, as well as to have a high cutting removal rate and high flatness of polishing wafer or semiconductor process, such that each finished product of Examples 1-4 is so suitably formed as a composite polishing pads for use in chemical-mechanical planarization (CMP) of wafer or semiconductor and effectively enhanced processing efficiency.

4. In comparison with Comparative Examples 1 whose porous material does not receive any heat treatment, it was found that the hardness of each finished product of Examples 1-4 was higher than that of the produced porous material of comparative example 1 only having the hardness of 81 Asker C.

For use in chemical-mechanical planarization (CMP) processing, each finished product of Examples 1-4 thanks to significantly increase in porosity, each is formed as a high-hardness substrate and gives the polished wafers a flatter surface and less rounded edges under higher cutting/grinding speed, and shows a considerably lower incidence rate of pore clogging (a phenomenon also referred to as glazing in the art of polishing pads).

5. In comparison with Comparative Examples 2 whose porous impregnated material is impregnated with resin solution S8 and does receive both sides of heat treatment for 3 minutes.

Since the resin solution S8 contains no polyvinyl chloride (PVC) resin added into a PU resin, it was found that both the hardness and the compressibility of each finished product of Examples 1-4 was higher than that of the produced porous material of comparative example 2 only having the hardness of 88 Asker C and the compression rate of 3.2%.

6. The cross section of each finished product of Examples 1-3 as shown in FIG. 1 has a polishing layer 11 with large pores and a buffer layer 12 with tiny pores, arranged in a gradated manner; while the cross section of the porous material of both comparative examples 1 or 2 as shown in FIG. 2 or 3 shows a uniform distribution of pores, which is undesirable.

7. The cross section of 3 mm thick finished product of Example 4 is a three-layer structure with a gradation of hardness. This product can be directly made into a substrate for surface planarization, or it can be cut along the middle line of the cross section to produce two substrates for surface planarization, each having a two-layer structure with sequentially arranged large pores and tiny pores. The latter approach is most economical in terms of manufacture.

Examples 5-10

A 1.25 mm thick porous material or porous resin substrate is produced by the same producing process as the Example 1 does, except that a 1.8 mm thick fibrous fabric is chosen to be impregnated with different resin solution from S2 to S7, each contains different types of PVC resins added in different amounts, respectively.

Shown as the following Table 3, the physical properties and internal structure of each corresponding porous material or porous resin substrate were determined, each of them has the hardness greater than 92 (on the Asker C scale, measured with the Asker durometer), the compression rate greater than 3.8%, and two layers were identified in the cross section with large pores and tiny pores arranged in a gradated manner.

Since a heat treatment is performed on one side through an IR heating tube, each corresponding porous material or porous resin substrate of Examples 5-10 featured high hardness, high compressibility, and an improvement in pore size distribution over those of comparative examples 1 and 2, since both of them only have uniform pore sizes in either large pores or tiny pores over their cross sections.

TABLE 3

Properties of porous material of Examples 5-10 heated with IR heating tube

| | | Examples No. | | | | | |
|---|---|---|---|---|---|---|---|
| | | 5 | 6 | 7 | 8 | 9 | 10 |
| Resin solution | | S2 | S3 | S4 | S5 | S6 | S7 |
| Thickness of porous reticulated film (mm) | | 1.25 | 1.25 | 1.25 | 1.25 | 1.25 | 1.25 |
| Processing method | Heating means | IR heating tube | | | | | |
| | Number of heated sides | 1 | 1 | 1 | 1 | 1 | 1 |
| | Processing speed (m/min) | 5 | 5 | 5 | 5 | 5 | 5 |
| | Temperature of heating (° C.) | 230 | 230 | 230 | 230 | 230 | 230 |
| | Heating time (sec) | 14.4 | 14.4 | 14.4 | 14.4 | 14.4 | 14.4 |
| Physical properties | Hardness (Asker C) | 92 | 93 | 94 | 94 | 94 | 92 |
| | Compression rate (%) | 4.8 | 4.8 | 3.8 | 3.8 | 3.8 | 5.2 |
| | Sectional configuration*8 | level #1 | level #1 | level #1 | level #1 | level #1 | level #1 |
| | Pore size on heated side | large pores | large pores | large pores | large pores | large pores | large pores |
| | Pore size on unheated side | tiny pores | tiny pores | tiny pores | tiny pores | tiny pores | tiny pores |
| Other features | Thickness of large-pore high-hardness layer (mm) | 0.65 | 0.65 | 0.65 | 0.65 | 0.65 | 0.65 |
| | Thickness of tiny-pore low-hardness layer (mm) | 0.6 | 0.6 | 0.6 | 0.6 | 0.6 | 0.6 |
| | Number of layers in cross section | two layers | two layers | two layers | two layers | two layers | two layers |
| | Buffering effect of polishing pad | good | good | good | good | good | good |

TABLE 3-continued

| Properties of porous material of Examples 5-10 heated with IR heating tube | | | | | | |
|---|---|---|---|---|---|---|
| | Examples No. | | | | | |
| | 5 | 6 | 7 | 8 | 9 | 10 |
| Flatness of polished wafer | good | good | good | good | good | good |

Note *8:
level #1 is represent for pores size is gradually arranged from large pores to tiny pores over entire cross section;

Examples 11-14

A 1.25 mm thick porous material or porous resin substrate is produced by the same producing process as the Example 1 does, except that an electric heating plate has replaced the IR heating tube of Example 1 and carried out a heat treatment under temperature of 220° C. for 120 seconds shown in Table 4, respectively. In addition, a 1.8 mm thick fibrous fabric is chosen to be impregnated with one of resin solutions selected from S1, S3, S5 and S7, each contains different types of PVC resins added in different amounts, respectively.

Shown as the following Table 4, the physical properties and internal structure of each corresponding porous material or porous resin substrate were determined, each of them has the hardness greater than 90 (on the Asker C scale, measured with the Asker durometer), the compression rate greater than 5.0%, and two layers were identified in the cross section with large pores and tiny pores arranged in a gradated manner.

Comparative Example 3

A 1.25 mm thick porous material or porous resin substrate is produced by the same producing process as the Comparative Example 2 does, except that the heating temperature for heat treatment is reduced from 220° C. to 170° C. for 180 seconds.

Shown as the following Table 4, the physical properties and internal structure of this material were determined, including the hardness is equal to 83 (on the Asker C scale, measured with the Asker durometer), the compression rate is equal to 5.2%, and single layer was identified in the cross section with uniform tiny pores densely distributed over entire cross section.

In comparison with Examples 11-14, according to the physical properties shown in Table 4, the heating temperature (170° C.) of comparative example 3 did not produce the desired heating effect on the final product.

The final porous material or porous resin substrate of the Comparative Example 3 has a lower hardness which is poor in cutting and grinding during a CMP planarization process for flattening the wafer surface.

Comparative Example 4

A 1.25 mm thick porous material or porous resin substrate is produced by the same producing process as the Comparative Example 2 does, except that the heating temperature for heat treatment is arisen from 220° C. to 235° C. for 180 seconds.

Shown as the following Table 4, the physical properties and internal structure of this material were determined, including the hardness is equal to 90 (on the Asker C scale, measured with the Asker durometer), the compression rate is equal to 3.2%, and single layer was identified in the cross section with uniform large pores densely distributed over entire cross section as well as the product experienced a change in hue from white to umber.

In comparison with Examples 11-14, according to the physical properties shown in Table 4, where the heat treatment was performed at 235° C. higher than 225° C. for a longer heating time for 3 minutes, the final product experienced a change in hue from white to umber, suggesting that a heating temperature of 235° C. or above may deteriorate the resins despite a marked heating effect on the resins.

The final porous material or porous resin substrate of the Comparative Example 4 has a poor buffer effect leading to inaccuracy in polishing during a CMP planarization process for flattening the wafer surface.

TABLE 4

| Properties of products of Examples 11-14 and Comparative Examples 3-4 | | | | | | | |
|---|---|---|---|---|---|---|---|
| | | Examples No. | | | | Comparative examples | |
| | | 11 | 12 | 13 | 14 | 3 | 4 |
| Resin solution | | S1 | S3 | S5 | S7 | S8 | S8 |
| Thickness of porous reticulated film (mm) | | 1.25 | 1.25 | 1.25 | 1.25 | 1.25 | 1.25 |
| Processing method | Heating means | Electric heating plate | | | | Circulated hot air | |
| | Number of heated sides | 1 | 1 | 1 | 1 | 2 | 2 |
| | Temperature of heating (° C.) | 220 | 220 | 220 | 220 | 170 | 235 |
| | Heating time (sec) | 120 | 120 | 120 | 120 | 180 | 180 |

TABLE 4-continued

Properties of products of Examples 11-14 and Comparative Examples 3-4

| | | Examples | | | | Comparative examples | |
|---|---|---|---|---|---|---|---|
| | | No. | | | | | |
| | | 11 | 12 | 13 | 14 | 3 | 4 |
| Physical properties | Hardness (Asker C) | 92 | 90 | 93 | 91 | 83 | 90 |
| | Compression rate (%) | 5.2 | 5.1 | 5.0 | 5.2 | 5.2 | 3.2 |
| | Sectional configuration*9 | level #1 | level #1 | level #1 | level #1 | level #2 | level #3 |
| | Pore size on heated side | large pores | large pores | large pores | large pores | tiny pores | large pores |
| | Pore size on unheated side | tiny pores | tiny pores | tiny pores | tiny pores | tiny pores | — |
| Other features | Thickness of large-pore high-hardness layer (mm) | 0.5 | 0.5 | 0.5 | 0.55 | none | 1.25 |
| | Thickness of tiny-pore low-hardness layer (mm) | 0.75 | 0.75 | 0.75 | 0.75 | 1.25 | none |
| | Number of layers in cross section | two layers | two layers | two layers | two layers | single layer | single layer |
| | Buffering effect of polishing pad | good | good | good | good | good | poor |
| | Flatness of polished wafer | good | good | good | good | poor | good |
| | Hue | white | white | white | white | white | umber |

Note *9:

level #1 is represent for pores size is gradually arranged from large pores to tiny pores over entire cross section; level #2 is represent for uniform tiny pores are densely distributed over entire cross section; level #3 is represent for uniform large pores are distributed over entire cross section;

Conclusion II:

1. The present invention is characterized in that a highly porous material or porous resin substrate (e.g. the composite polishing pad 10 of FIG. 1) is formed by flocculating resins in polyester-based fibrous fabric and is subsequently modified by a heat treatment in order to have a layered structure with a gradation of hardness and thus exhibit the features of composite polishing pads.
2. The preferred porous material or porous resin substrate, if produced form the preferred Example 1 according to the manufacturing method of the present invention, has high hardness (92 on the Asker C scale) and high compressibility (with a compression rate of 5.2%).

Moreover, the porous material or porous resin substrate, when put to use in a polishing operation, has proved to have a buffer function, a high cutting removal rate, high flatness, and have the ability to effectively increase processing efficiency.

The heat treatment of the present invention also imparted high hardness and high compressibility to the porous material or porous resin substrate in the other Examples.
3. In other words, the present invention successfully overcame the low hardness problem of comparative example 1 (whose hardness was 81 on the Asker C scale) and the low compressibility problem of comparative example 2 (whose compression rate was 3.2%).
4. The product of the preferred Example 4 of the present invention was 3 mm thick and had a three-layer gradated structure. This product can be directly made into a substrate for surface planarization. Alternatively, it can be cut along the middle line of the cross section to produce two substrates for surface planarization, each having a two-layer structure with sequentially arranged large pores and tiny pores. The latter approach is most economical in terms of manufacture.
5. The product of comparative example 1 received no heat treatment, had a cross section with uniform tiny pores densely distributed in a single layer, and was not hard enough for grinding and cutting. The product of comparative example 2, on the other hand, received a complete heat treatment, had a cross section with large pores distributed in a single layer, featured high hardness, but performed poorly in terms of buffering, leaving the polished wafers scratched, broken, or otherwise defective.
6. A comparison between the silicon wafers polished with the heat-treated polishing substrates of the present invention and those polished with the unheated polishing substrate in comparative example 1 shows that the former silicon wafers were flatter and had less rounded edges, and that the former substrates had better grinding and cutting ability and were far less likely to have their pores clogged (or glazed), thanks to the high porosity of the substrates.
7. The physical properties of the products of comparative examples 3 and 4 suggest that a heating temperature of 170° C. or lower cannot produce the desired resin heating effect, and that a heating temperature of 235° C. or higher does produce the desired resin heating effect but tends to change the hue of the treated resin, meaning the resin may have deteriorated. The heating temperature is preferably set at 180-230° C. A lower temperature setting is economically inefficient because a longer heating time is required. The most suitable heating temperature for industrial production ranges from 190 to 230° C.

What is claimed is:

1. A process for producing a composite polishing pad for use in surface planarization processing, comprising the steps of:

1) preparing a thermosetting resin solution containing a solid content being 8-30 wt %; which composition consisting of the following ingredients a)-h), based on total weight of the thermosetting resin solution and add up to 100 wt %:
   a) resins at 12.5-22.0 wt %, including a PU resin at 70-95 wt % and a PVC resin at 30-5 wt %, based on the total weight of the resins;
   b) a N,N-dimethylformamide (DMF) solvent or a N,N-dimethylacetamide (DMA) solvent, at 60-85 wt %;
   c) surfactants at 2-12 wt %;
   d) an anti-foaming agent at 0.1-1 wt %;
   e) a water repellant at 0.1-3 wt %;
   f) a plasticizer at 0.1-3 wt %; selected from a diisononyl phthalate (DINP) or a tri(2-ethylhexyl) trimellitate (TOTM);
   g) inorganic powder at 0.1-3 wt %; which is one or more powders selected from the group consisting of spherical or irregular $SiO_2$, $TiO_2$, $Al(OH)_3$, $Mg(OH)_2$, $CaCO_3$ and fumed silica; and
   h) a stabilizer at 0.1-2 wt %, being a phenol-free calcium-zinc stabilizer;
2) choosing a fibrous fabric, and impregnating the fibrous fabric with the thermosetting resin solution of step 1) as an impregnated fibrous fabric prepared for flocculation;
3) allowing the impregnated fibrous fabric of step 2) is flocculated in water or DMF solution to form as a porous resin substrate after the resins filled into the impregnated fibrous fabric is flocculated, and subsequently washing and drying are completed;
4) heating the porous resin substrate of step 3) on one or both sides with an infrared (IR) heating tube or an electric heating plate for heat treatment under heating temperature of 180-230° C. for 8-180 seconds, to obtain a modified porous resin substrate; and
5) removing a skin on an upper surface and/or a lower surface of the modified porous resin substrate by cutting and grinding, to obtain a 0.45-4.0 mm thick composite polishing pad whose entire cross sectional structure is a two-layered or three layered structure derived from each layer provided for different pores size and different hardness.

2. The process for producing a composite polishing pad of claim 1, wherein the PVC resin of step 1) is composed of a vinyl chloride-vinyl acetate copolymer at 30-80 wt % and an emulsion-polymerized PVC powder at 70-20 wt %.

3. The process for producing a composite polishing pad of claim 2, based on the total weight of the PVC resin, the emulsion-polymerized PVC powder includes:
   i) a high-molecular-weight emulsion-polymerized PVC powder at 20-40 wt %, having an average degree of polymerization (DP) ranging from 1650 to 1850 and a Fikentscher's constant ranging from 77.2 to 81; and
   ii) a low-molecular-weight emulsion-polymerized PVC powder at 0-30 wt %, having an average degree of polymerization (DP) ranging from 1350 to 1550 and a Fikentscher's constant ranging from 73.0 to 76.5.

4. The process for producing a composite polishing pad of claim 1, wherein the heat treatment of step 4) is under a heating temperature of 190-230° C. for 8-180 seconds.

5. The process for producing a composite polishing pad of claim 1, wherein the surfactants of step 1) comprises anionic surfactants at 1.5-10 wt % and non-ionic surfactants at 0.5-5 wt %; wherein the anionic surfactant is one or more surfactants selected from the group consisting of ammonium lauryl sulfate, triethanolamine lauryl sulfate and sodium lauryl sulfate; and wherein the non-ionic surfactant is a polyoxy ethylene nonyl phenyl ether.

6. The process for producing a composite polishing pad of claim 1, wherein the water repellant of step 1) is a silane-based compound or a siloxane-based compound.

7. The process for producing a composite polishing pad of claim 1, wherein the water repellant of step 1) is a poly(1,1-dihydro-fluoroalkyl acrylate) or a fluoroalkyl methacrylates.

8. The process for producing a composite polishing pad of claim 1, wherein the water repellant of step 1) is a BIONIC-FINISH®ECO supplied by RUDOLF.

9. The process for producing a composite polishing pad of claim 1, wherein the inorganic powder of step 1) has an average particle size ($D_{50}$) ranging from 0.01 to 20 μm.

10. The process for producing a composite polishing pad of claim 1, wherein the inorganic powder of step 1) is shaped as fibrous powder of which fiber diameter is 0.1-5 μm and has a ratio of fiber length to fiber diameter greater than 2.

11. A polishing pad made by the process of claim 1, having a thickness between 0.45 mm and 4.0 mm, and comprising an upper half formed as a polishing layer having a thickness equal to or greater than 0.3 mm, and a lower half formed as a buffer layer having a thickness equal to or greater than 0.15 mm.

12. The polishing pad of claim 11, having a thickness between 0.8 mm and 4.0 mm, and the polishing layer having a thickness equal to or greater than 0.5 mm, and the buffer layer having a thickness equal to or greater than 0.3 mm.

* * * * *